US010494872B2

(12) United States Patent
Crawford

(10) Patent No.: US 10,494,872 B2
(45) Date of Patent: Dec. 3, 2019

(54) DRILL BIT ARM POCKET

(71) Applicant: Halliburton Energy Services, Inc., Houston, TX (US)

(72) Inventor: Micheal Burl Crawford, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 17 days.

(21) Appl. No.: 15/025,467

(22) PCT Filed: Oct. 31, 2013

(86) PCT No.: PCT/US2013/067804
§ 371 (c)(1),
(2) Date: Mar. 28, 2016

(87) PCT Pub. No.: WO2015/065440
PCT Pub. Date: May 7, 2015

(65) Prior Publication Data
US 2016/0237753 A1 Aug. 18, 2016

(51) Int. Cl.
*E21B 10/20* (2006.01)
*E21B 47/01* (2012.01)
*E21B 10/08* (2006.01)

(52) U.S. Cl.
CPC ..... *E21B 10/20* (2013.01); *E21B 10/08* (2013.01); *E21B 47/01* (2013.01)

(58) Field of Classification Search
CPC ..... E21B 10/20; E21B 10/08; E21B 47/01; E21B 10/60
See application file for complete search history.

(56) References Cited

U.S. PATENT DOCUMENTS

| | | | |
|---|---|---|---|
| 5,439,068 | A | 8/1995 | Huffstutler et al. |
| 5,553,681 | A | 9/1996 | Huffstutler et al. |
| 5,606,895 | A | 3/1997 | Huffstutler |
| 5,755,297 | A | 5/1998 | Young et al. |
| 6,450,270 | B1 | 9/2002 | Saxton |
| 7,182,162 | B2 | 2/2007 | Beuershausen et al. |
| 7,918,292 | B2 | 4/2011 | Felderhoff et al. |
| 8,079,427 | B2 | 12/2011 | Felderhoff et al. |
| 8,312,942 | B2 | 11/2012 | Ho et al. |

(Continued)

OTHER PUBLICATIONS

International Search Report and Written Opinion, Application No. PCT/US2013/067804, 14 pages, dated Jul. 21, 2014.

*Primary Examiner* — David J Bagnell
*Assistant Examiner* — Brandon M Duck
(74) *Attorney, Agent, or Firm* — Baker Botts L.L.P.

(57) ABSTRACT

A disclosed embodiment for a drill bit arm for a rotary subterranean drill bit includes a pocket that extends radially inward from an outer surface of the drill bit arm. The pocket may include a void where work piece material has been removed. The pocket may be next to a leading edge of the drill bit arm and may extend to remove at least a portion of a trailing edge of the drill bit arm. When the drill bit arm includes a lifting surface, the pocket may be next to and follow an upward curvature of the lifting sur face. The pocket may reduce wear and tear on the drill bit arm during operation. The pocket may provide a location for placing a desired piece of equipment, such as an instrumentation element and/or a communication element.

20 Claims, 4 Drawing Sheets

(56) References Cited

U.S. PATENT DOCUMENTS

| | | | | |
|---|---|---|---|---|
| 2005/0109544 | A1 | 5/2005 | Ray et al. | |
| 2011/0266054 | A1* | 11/2011 | Kumar | E21B 10/08 175/39 |
| 2012/0273280 | A1* | 11/2012 | Zhang | E21B 10/573 175/428 |

* cited by examiner

DRILL BIT ARM POCKET

RELATED APPLICATIONS

This application is a U.S. National Stage Application of International Application No. PCT/US2013/067804 filed Oct. 31, 2013, which designates the United States, and which is incorporated herein by reference in its entirety.

TECHNICAL FIELD

This disclosure relates generally to subterranean drilling equipment and, more particularly, to a drill bit arm pocket.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a borehole at a desired well site, treating the borehole to optimize production of hydrocarbons, and performing the necessary steps to produce and process the hydrocarbons from the subterranean formation.

Drill bits used for drilling a borehole, such as rotary cone drill bits, are typically made by forging and/or casting processes to produce a rough part, followed by machining and/or surface treatment to attain a desired geometry and surface finishing. A drill bit may include support members that include a lifting surface for providing upward pressure to a drilling fluid when the drill bit is rotated. Drilling fluids may also be used to clean, cool and lubricate cutting elements, cutting structures and other components associated with a roller cone drill bit. Drilling fluids may assist in breaking away, abrading and/or eroding adjacent portions of a down hole formation. The support members may also support rotary cone cutters whose teeth pulverize an earth formation during operation.

FIGURES

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DESCRIPTION OF PARTICULAR EMBODIMENT(S)

The present disclosure relates generally to well drilling equipment and, more particularly, to drill bit arm pockets. These drill bit arm pockets may serve to lighten the drill bit and decrease an amount of material used for the drill bit, while preserving desirable fluid flow characteristics provided by other features of the drill bit arm.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear boreholes in any type of subterranean formation. Embodiments may be applicable to injection wells as well as production wells, including natural resource production wells such as hydrogen sulfide, hydrocarbons or geothermal wells. Devices and methods in accordance with embodiments described herein may be used in one or more of wire line, slick line, measurement while drilling (MWD) and logging while drilling (LWD) operations. Embodiments described below with respect to one implementation, such as wire line, are not intended to be limiting. Embodiments may be implemented in various formation tools suitable for measuring, data acquisition and/or recording data along sections of the formation that, for example, may be conveyed through flow passage in tubular string or using a wire line, slick line, tractor, piston, piston-tractor, coiled tubing, down hole robot or the like. Embodiments may be implemented in various size drill bits, such as, but not limited to the sizes of drill bits listed in Table 1.

TABLE 1

Drill bit designations and sizes.

| DRILL BIT DESIGNATION | DRILL BIT OUTER DIAMETER |
|---|---|
| Slim Hole | 4⅜" to 6¾" |
| A and B | 7⅜" to 12⅝" |
| XL | 13½" to 19½" |
| Jumbo | 20" to 28" |

Figure 1:
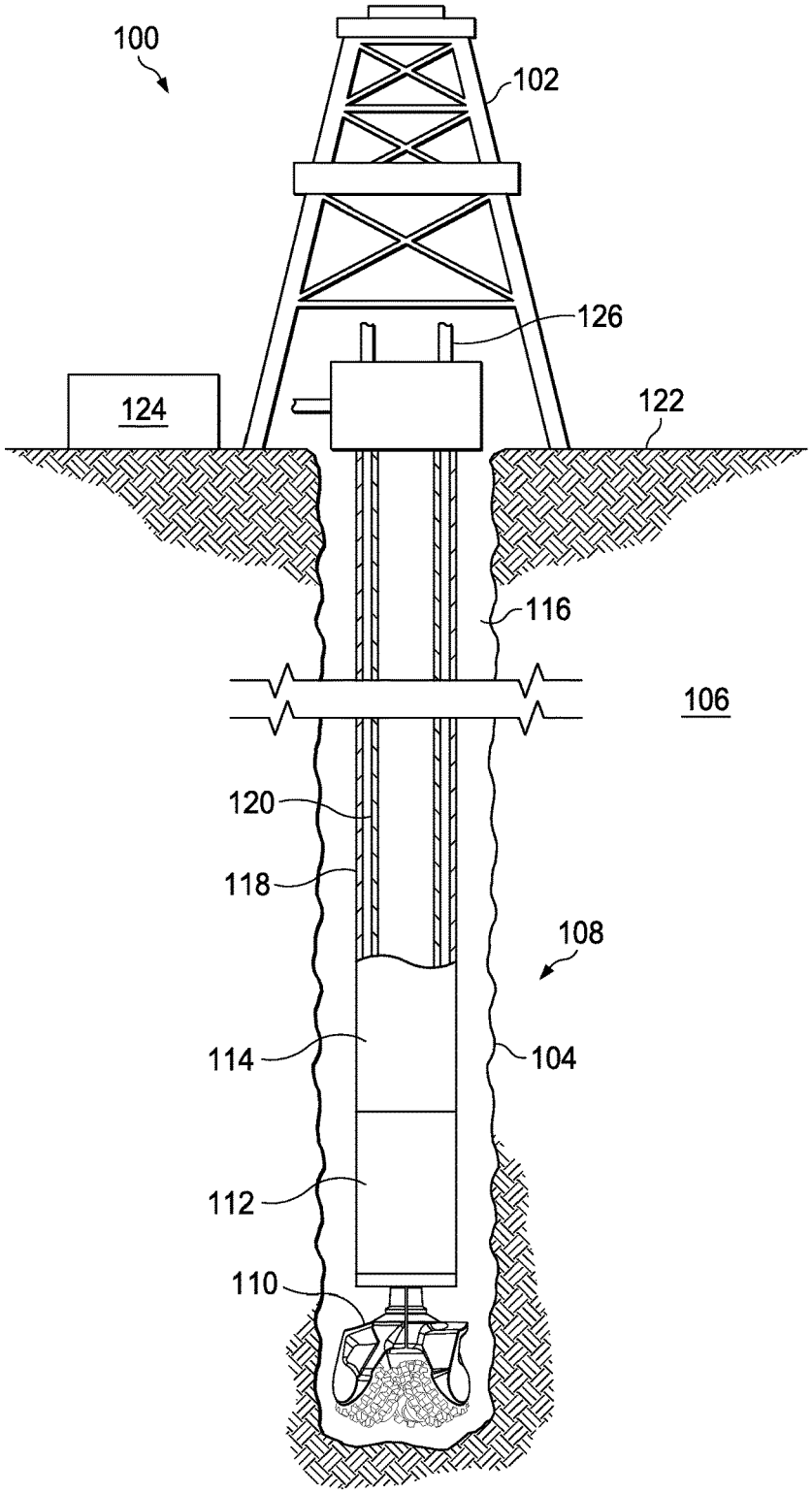
FIG. 1 is a block diagram of selected elements of an embodiment of an example drilling system.

Turning now to the drawings, FIG. 1 shows selected elements of an embodiment of a drilling system 100. As shown, the drilling system 100 includes rig 102 mounted at surface 122, positioned above borehole 104 within subterranean formation 106. In FIG. 1, the rig 102 may be connected to multiple drilling pipes 118 and 120 via top drive 126. The drilling system 100 may include a pipe-in-pipe drilling system where an inner pipe 120 may be disposed within an outer pipe 118. Drilling mud, for example, may be pumped into borehole 104 within the annulus defined by inner pipe 120 within outer pipe 118. The drilling mud may be pumped down hole through bottom hole assembly (BHA) 108 to drill bit 110. The BHA 108 may include various down hole tools and/or another LWD/MWD element 112, which may be coupled to outer pipe 118 and inner pipe 120. In certain embodiments, the drilling fluid may return to surface 122 within annulus 116, or be diverted into inner pipe 120. A control unit 124 at surface 122 may control the operation of at least some of the drilling equipment.

In FIG. 1, the drill bit 110 may be a rotary cone drill bit, and may have a number of drill bit arms each having a cone for respectively supporting a rotary cone cutter. The embodiment depicted in FIG. 1 includes, by way of example, three drill bit arms each supported on a respective cone, although a different number of drill bit arms and associated cones may be used. When assembled, the cone cutters may mate with one another to produce an effective cutting tool for drilling a borehole in a geological formation when drill bit 110 is rotated at the end of a drill string. The drill bit arms of the drill bit 110 may include a lifting surface that provides upward pressure to the drilling fluid circulating around drill bit 110. In operation, the drill bit arms of drill bit 110 each support a respective rotary cone and keep the rotary cone attached to the drill string. Each drill bit arm may also provide a lifting surface for the drilling fluid, when the drill bit is rotated.

The drill bit arms of a roller cone bit may be manufactured in any of a variety of ways. Typically, although not exclusively, the drill bit arms are forged (or cast) from a single work piece and then subsequently machined, which involves a certain amount of work piece material and machining time, both of which represent expenses in forming the drill bit. In certain instances, the machining time for the drill bit arm may be related to an overall external surface area of portions of the drill bit arm. As will be described in further detail, drill bit 110 may use drill bit arms having a pocket (not shown in FIG. 1, see FIGS. 3 and 4) created therein during forging, casting, and/or another forming process. The pocket in the drill bit arms of drill bit 110 may represent work piece material that has been eliminated with respect to a conventional forming process for drill bit arms. The pockets may serve to reduce an amount of material in drill bit 110 when compared to conventional drill bits, which may save material cost. The pockets may result in reduced machining time and effort for forming drill bit 110 when compared to conventional drill bits, which may further reduce manufacturing cost. The pockets may, however, still provide adequate strength and support for the rotary cone, on which a rotary cone cutter may be mounted, during operation of drill bit 110. In some embodiments, when drill bit 110 is designed with lifting surfaces that generally involve additional work piece material at the drill bit arms of drill bit 110, the above mentioned features of the pockets may be particularly advantageous in optimizing an amount of work piece material and manufacturing effort to produce drill bit 110.

Figure 2:
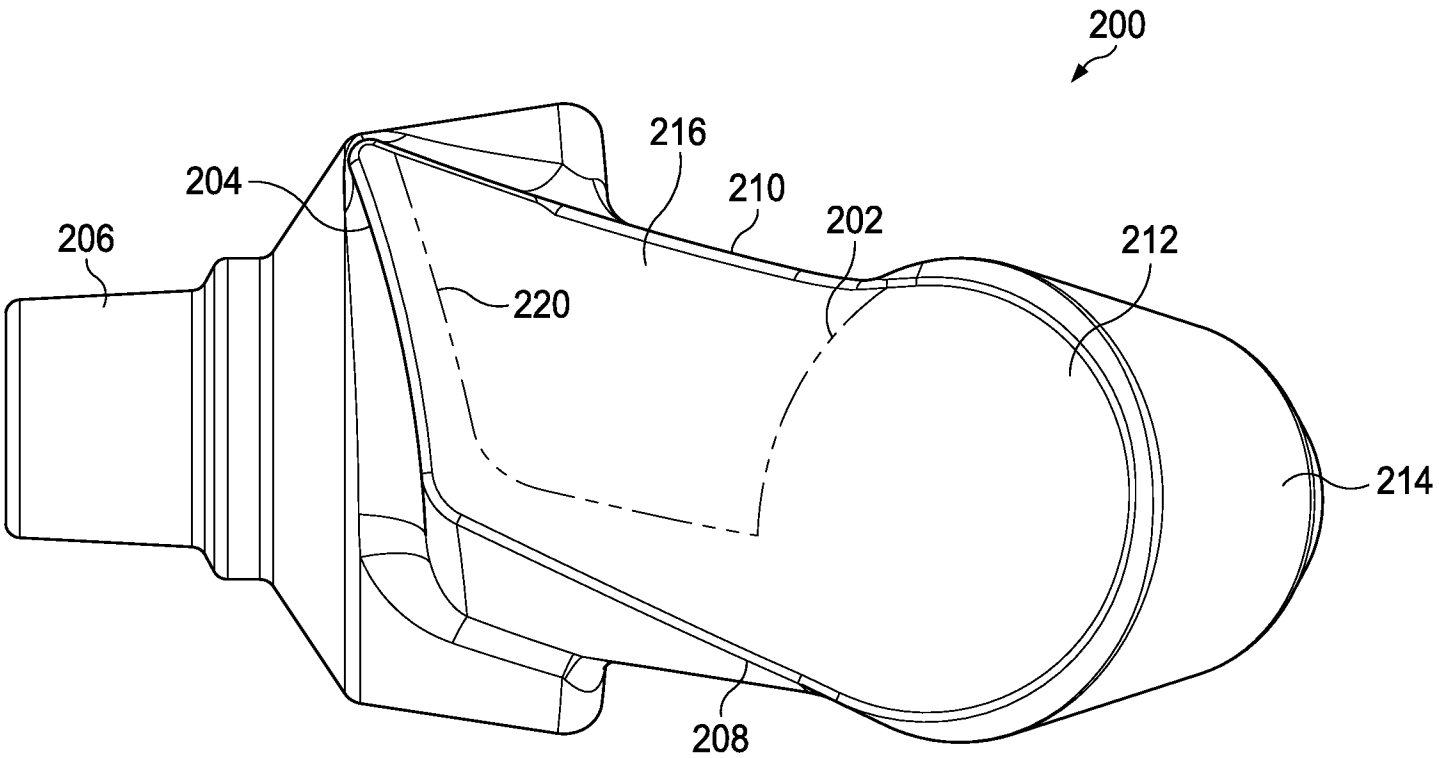
FIG. 2 illustrates selected elements of an embodiment of a drill bit arm showing where a pocket may be included therein.

Turning now to FIG. 2, drill bit arm 200 is illustrated. In FIG. 2, drill bit arm 200 is shown including upper portion 206, outer surface 202 having lifting surface 204, leading edge 208, trailing edge 210, and lower portion 212 including rotary cone 214 for supporting a rotary cone cutter (not shown). Drill bit arm 200 is shown as a 120° geometrical section, of which 3 such sections may be mated to form a drill bit having 3 cutting elements. Outer surface 202 may represent a surface of support member 216 of drill bit arm 200, that joins upper portion 206 and lower portion 212. Support member 216 and lower portion 212 of drill bit arm 200 may be suspended and held in place by upper portion 206. In drill bit arm 200, support member 216 includes outer surface 202, which may have a relatively large area that may be machined after drill bit arm 200 is forged and/or cast.

Also shown in FIG. 2 is pocket outline 220, depicting a region of support member 216 from where material may be removed to form a pocket, as described with respect to FIGS. 3 and 4 below. A depth of the pocket at pocket outline 220 may vary, as desired. In certain embodiments, pocket outline 220 may represent a maximum line for material removal, such that a smaller amount of material than given by pocket outline 220 may be removed when forming drill bit arm 200. A precise location of pocket outline 220 may be determined for a given instance of drill bit arm 200, for example, by using a geometrical material simulation to calculate and/or estimate stress concentrations within drill bit arm 200 under expected loading conditions, such as during drilling operations. Thus, an exact position of pocket outline 220 may vary according to a design and/or dimension of drill bit arm 200, expected service conditions for drill bit arm 200, and a desired strength and/or toughness of drill bit arm 200, as example criteria, among others. In certain embodiments, where a pocket given by pocket outline 220 is desired within an existing instance of drill bit arm 200, material may be removed from drill bit arm 200 to form the pocket. The material removal process may include machining, forging, and/or a cutting operation. After forming the pocket using any of various means described herein and as given by pocket outline 220, a heat treatment may be applied to drill bit arm 200 to relieve stress and/or achieve a desired metallurgical condition.

In the embodiment of FIG. 2, the drill bit arm 200 includes lifting surface 204 to improve upward circulation of a drilling fluid (not shown) during drilling operations. As shown, lifting surface 204 may represent an inclined horizontal surface that may curve in an upward direction with respect to a desired rotational direction of drill bit arm 200. The upward curvature of lifting surface 204 may impart (or increase) an upward force, or pressure, applied to the drilling fluid when the drill string rotates. Lifting surface 204 may have a generally upward inclination relative to outer surface 202 of respective support member 216 and with respect to a bit rotational axis (not shown). A configuration and dimensions of each lifting surface 204 may be selected to assist in forming a respective fluid stream (not shown) having a generally upward spiral in the well bore. Because the formation of lifting surface 204 may be realized by adding additional material to drill bit arm 200, the formation of a pocket at pocket outline 220 may be particularly advantageous in achieving an optimum balance between an amount of material used to form drill bit arm 200 and a desired strength of drill bit arm 200.

In operation, drill bit arm 200 is designed to rotate in a direction causing leading edge 208 to lead, trailing edge 210 to trail, and causing lifting surface 204 to generate an lifting force on the drilling fluid in the direction of a drill string (see FIG. 1) to which drill bit arm 200 may be attached. Drill bit arm 200 may further operate in a desired manner when the pocket given by pocket outline 220 is included therein. The pocket may reduce an overall weight of a drill bit in which 3 instances of drill bit arm 200, for example, have been joined. The pocket may reduce an external resistance, or friction, of the drill bit within the well bore. The pocket may reduce overall wear and tear on the drill bit arm by reducing a relative area that comes into contact with the well bore.

Figure 3:
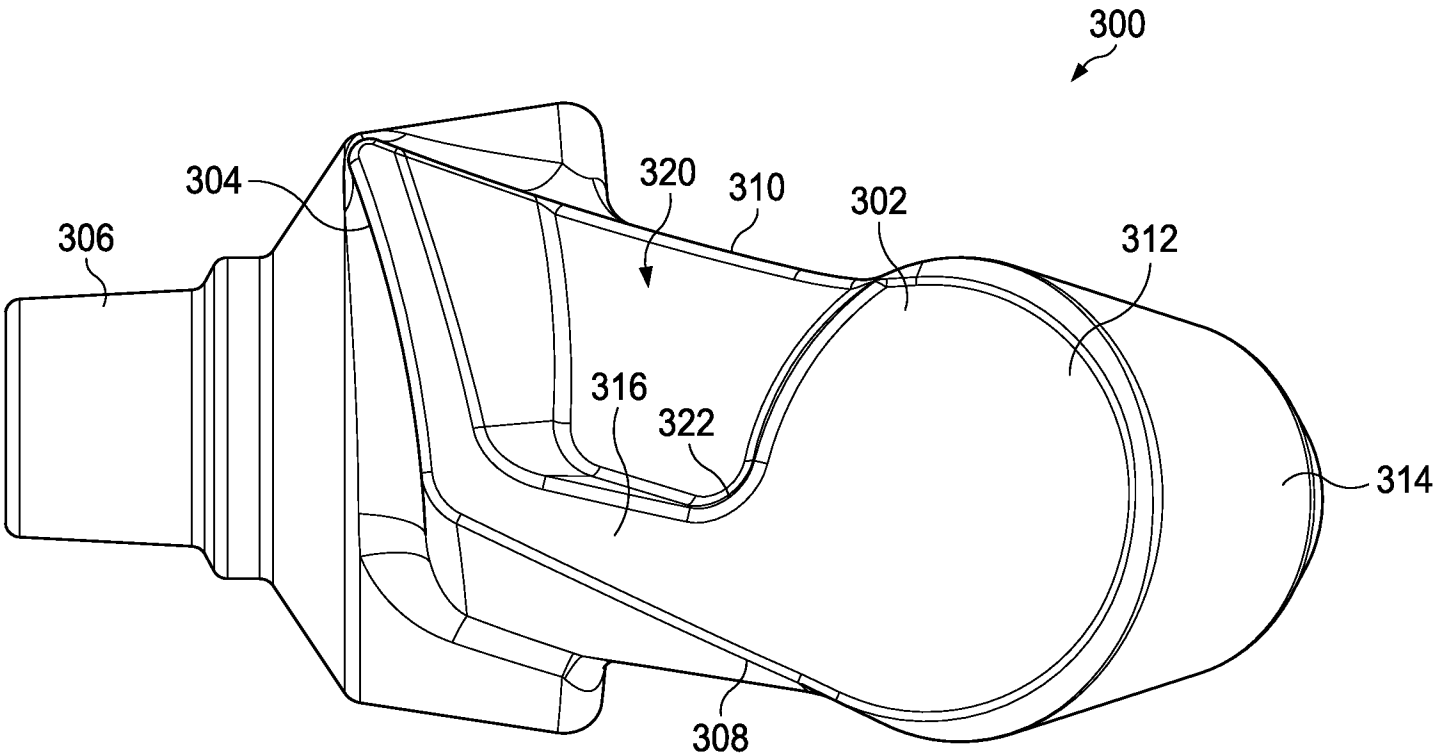
FIG. 3 illustrates selected elements of an embodiment of a drill bit arm having a pocket therein.

Turning now to FIG. 3, selected elements of an embodiment of drill bit arm 300 are illustrated. In FIG. 3, drill bit arm 300 is shown in a face view, showing upper portion 306, outer surface 302 having lifting surface 304, leading edge 308, trailing edge 310, and lower portion 312 including rotary cone 314 for supporting a rotary cone cutter (not shown). Drill bit arm 300 is shown as a 120° geometrical section, of which 3 such sections are mated to form a drill bit having 3 cutting elements. Outer surface 302 may represent a surface of support member 316 of drill bit arm 300, that joins upper portion 306 and lower portion 312.

Support member 316 and lower portion 312 of drill bit arm 300 may be suspended and held in place by upper portion 306.

In FIG. 3, drill bit arm 300 is shown including pocket 320, representing a void where work piece material has been selectively removed to form support member 316. Pocket 320 may have various shapes and having various edges. A shape and/or a size of pocket 320 may be dimensioned based on a material used to form at least support member 316 of drill bit arm 300. Certain edges and corners of support member 316 may have a minimum radius of curvature, such as corner 322, among others, to reduce internal stresses when drill bit arm 300 is in operation. A portion of trailing edge 310 has been removed, while an edge of pocket 320 may follow to leading edge 308 on drill bit arm 300. In other words, pocket 320 may begin next to leading edge 308 and may extend to remove at least a portion of trailing edge 310. In forming pocket 320, a desired strength and fluid lifting capacity of drill bit arm 300 may be retained and/or improved.

In some embodiments of drill bit arm 300 depicted in FIG. 3, outer surface 302, representing an external surface of support member 316, may be significantly reduced due to the formation of pocket 320, as noted above. Outer surface 302 may represent an external surface at a maximum circumference of a drill bit, for example, when 3 instances of drill bit arm 300 are joined to form the drill bit. As an external surface, outer surface 302 may come into contact with the well bore during drilling operations and may experience significant mechanical wear and tear as a result of such contact (e.g., abrasion, deformation, scratching, gouging, cracking, etc.). As a result of a reduction in an area of outer surface 302 due to formation of pocket 320 therein, the area subject to such mechanical wear and tear may be reduced. In certain embodiments, the resulting wear and tear may be reduced overall for a drill bit. In given embodiments, outer surface 302 may be additionally strengthened using any of a variety of surface hardening processes and/or various combinations therefor. Because of the reduction in area, certain surface hardening processes involving additional expenses and/or resources and being dependent on a treated area may become economically feasible for improving the wear properties of outer surface 302. The surface hardening processes applicable to outer surface 302 may include quench hardening, heat treatment, compositional treatment (e.g., adding carbon and/or other solutes to a ferrous matrix, such as iron or steel), and various combinations thereof. The surface hardening processes applicable to outer surface 302 may include various types of coatings that may be applied to or grown on outer surface 302, such as a ceramic coating, a crystalline coating, powder coatings, and or an alloy coating. In particular embodiments, a very hard material may be coated on to outer surface 302, such as diamond, sapphire, quartz, etc. The surface hardening processes applicable to outer surface 302 may include forming an alloy that is compositionally different that other portions of drill bit arm 300. For example, an alloy may be composed by altering a composition over a certain depth of outer surface 302, which may be different than applying the coating mentioned previously.

Additionally, the surface hardening process may include adding an insert (not shown in the drawings) to outer surface 302. The insert may by anchored to drill bit arm 300 and may cover at least a portion of outer surface 302. In certain embodiments, the insert may extend beyond outer surface 302 and extend further upwards (i.e., towards upper portion 306) along the drill bit to improve protection of pocket 320 and the drill bit in general by increasing wear resistance due to a high hardness of a material used in the insert. In given embodiments, the inserts may comprise a hardened material, such as a carbide (e.g., tungsten carbide, titanium carbide, chromium carbide, molybdenum carbide, among other examples), a high carbon steel, and/or another high hardness material.

Accordingly, various types and/or combinations of surface hardening processes for outer surface 302 may be used, for example, to attain optimal mechanical properties of a drill bit for a specific application (e.g., a type of well, a depth of a well, type(s) of geological formations with a well, etc.). As a result of the surface hardening process, the wear and tear properties of drill bit arm 300 may be significantly improved, while still resulting in an economically competitive cost for manufacturing a drill bit using drill bit arm 300.

Furthermore, as shown in FIG. 3, pocket 320 may be next to an upwardly curved surface, given by lifting surface 304, in support member 316. Lifting surface 304 may provide upward pressure to a drilling fluid when the drill bit is rotated in a borehole. An upper edge of pocket 320 may follow a shape of lifting surface 304 and also be upwardly curved. In operation, drill bit arm 300 may be designed to rotate in a direction causing leading edge 308 to lead, trailing edge 310 to trail, and causing lifting surface 304 to generate an lifting force in the direction of a drill string (see FIG. 1) to which drill bit arm 300 is attached.

Figure 4:
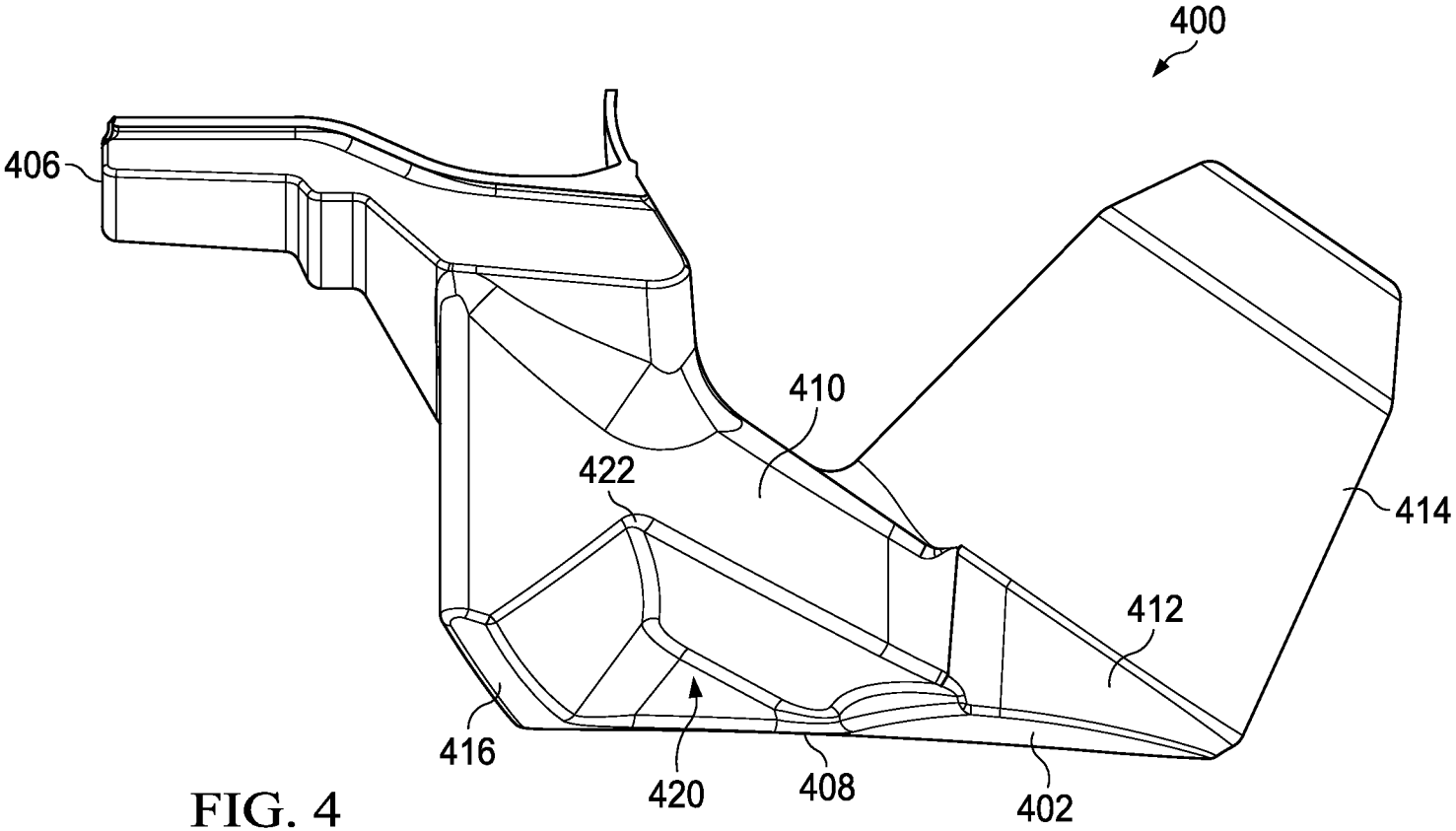
FIG. 4 illustrates selected elements of an embodiment of a drill bit arm having a pocket therein.

Turning now to FIG. 4, selected elements of an embodiment of drill bit arm 400 are illustrated. In FIG. 4, drill bit arm 400 is shown in a side view, showing upper portion 406, outer surface 402 having leading edge 408, trailing edge 410, and lower portion 412 including rotary cone 414 for supporting a rotary cone cutter (not shown). Drill bit arm 400 is shown as a 120° geometrical section, of which 3 such sections are mated to form a drill bit having 3 cutting elements. Outer surface 402 may represent a surface of support member 416 of drill bit arm 400, that joins upper portion 406 and lower portion 412. The support member 416 and lower portion 412 of drill bit arm 400 may be suspended and held in place by upper portion 406. In operation, drill bit arm 400 may be designed to rotate in a direction causing leading edge 408 to lead and trailing edge 410 to trail.

In FIG. 4, drill bit arm 400 is shown including pocket 420, representing a void where work piece material has been selectively removed to form support member 416. Pocket 420 may have various shapes and having various edges. A shape and/or a size of pocket 420 may be dimensioned based on a material used to form at least support member 416 of drill bit arm 400. Certain edges and corners of support member 416 may have a minimum radius of curvature, such as corner 422, among others, to reduce internal stresses when drill bit arm 400 is in operation. On drill bit arm 400, a portion of trailing edge 410 has been removed, while an edge of pocket 420 may follow to leading edge 408. In other words, pocket 420 may begin next to leading edge 408 and may extend to remove at least a portion of trailing edge 410. In forming pocket 420, a desired strength of drill bit arm 400 may be retained and/or improved.

In operation, a drill bit having drill bit arms may be used to drill a borehole in a subterranean formation. The drill bit may be positioned at the end of a drill string through which a drilling fluid may be circulated through the drill bit while drilling. The drilling fluid may serve to cool the drill bit and may carry removed geological material (i.e., drill bit cuttings) away from the drill bit and to the surface as fresh drilling fluid is introduced.

Additionally, the leading edge of the drill bit arm having a pocket as well as an upwardly curved edge (i.e., the lifting surface) of the drill bit arm may generate an upward pressure to the drilling fluid when the drill bit is rotated in a borehole. The presence of the pocket may sustain this upward pressure the drilling fluid. In various embodiments, the presence of the pocket may also serve to maintain and/or improve flow properties of the drilling fluid, for example, by not decreasing or increasing a flow rate of the drilling fluid in an upward direction and/or by not deteriorating or improving a quality of the local flow properties of the drilling fluid.

Furthermore, because the pocket includes a void that extends radially inward from the outer surface of the drill bit arm, a surface area of the outer surface of the drill bit arm is effectively reduced. During operation in the borehole, the outer surface rotates and may come into contact with the walls of the borehole, causing wear and tear on the drill bit arm and also creating resistance (i.e., friction) that works against the rotation of the drill bit. This undesired resistance or friction may be associated with a contact area of the outer surface of the drill bit arm that meets the borehole wall. When the contact area of the outer surface is reduced due to the presence of the pocket in the drill bit arm, there may be less material to contact the borehole walls and the resistance or friction may correspondingly be reduced, which, in turn, may reduce the wear and tear on the drill bit arm and/or extend a service life of the drill bit.

At least a portion of the pocket may be used to house a functional element or piece of equipment associated with the drilling operations. For example, an instrumentation and/or communication element (i.e., sensor, electronic component, power supply, communication element, networking element, etc.) may be placed in the pocket during operation of the drill bit. The pocket may provide a secure location for housing a desired piece of equipment. In certain embodiments, a shape of the pocket may protect a piece of equipment located therein from undesired exposure, for example, to the borehole walls. In other embodiments, a shape of the pocket may enable a piece of equipment located therein to come within a defined proximity with and/or to contact the borehole walls. An instrumentation element placed in the pocket may mate with a shape of the pocket, or may reside in a housing that mates with a shape of the pocket. In certain embodiments, an instrumentation element may be fixed or attached to remain within the pocket during drilling operations.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A drill bit for subterranean drilling, comprising:

a plurality of support members in a plurality of drill bit arms, each support member including an outer surface and a lifting surface having an upwardly curved shape, each support member also configured to receive a respective cutting element; and at least one of the plurality of support members defining a pocket, wherein the pocket extends radially inward from the outer surface, the pocket has an upper edge that follows the upwardly curved shape of the lifting surface, the pocket has at least one edge or corner with minimum radius of curvature sufficient to reduce internal stress when the drill bit is rotated in a borehole, and the pocket retains and/or improves at least one of strength or lifting capacity of the drill bit arm.

2. The drill bit of claim 1, wherein the plurality of support members is 3 support members.

3. The drill bit of claim 1, wherein each pocket is next to an upwardly curved surface of the lifting surface in each of the plurality of support members, the upwardly curved surface providing upward pressure to a drilling fluid when the drill bit is rotated in the borehole.

4. The drill bit of claim 3, wherein an upper edge of each pocket follows the upwardly curved surface.

5. The drill bit of claim 1, wherein each pocket is next to a leading edge of each of the plurality of support members.

6. The drill bit of claim 1, wherein each pocket extends to at least a portion of a trailing edge of each of the plurality of support members.

7. The drill bit of claim 1, wherein each pocket has curved edges having a predetermined minimum radius of curvature.

8. The drill bit of claim 1, wherein each pocket houses an instrumentation element during operation of the drill bit.

9. The drill bit of claim 8, wherein the instrumentation element includes a communication element.

10. The drill bit of claim 1, wherein each pocket reduces a surface area of the outer surface.

11. A drill bit arm for a drill bit for subterranean drilling, comprising:

an upper portion for joining to other arms of the drill bit;

a lower portion for receiving a cutting tool; and a support member connecting the upper portion and the lower portion, the support member including a lifting surface having an upwardly curved shape and a pocket configured in an outer surface, the pocket has an upper edge that follows the upwardly curved shape of the lifting surface, the pocket has at least one edge or corner with minimum radius of curvature sufficient to reduce internal stress when the drill bit is rotated in a borehole, and the pocket retains and/or improves at least one of strength or lifting capacity of the drill bit arm.

12. The drill bit arm of claim 11, wherein the drill bit comprises 3 drill bit arms.

13. The drill bit arm of claim 11, wherein the pocket is next to an upwardly curved surface of the lifting surface in the support member, the upwardly curved surface providing upward pressure to a drilling fluid when the drill bit is rotated in a borehole.

14. The drill bit arm of claim 13, wherein an upper edge of the pocket follows the upwardly curved surface.

15. The drill bit arm of claim 11, wherein the pocket is next to a leading edge of the support member.

16. The drill bit arm of claim 11, wherein the pocket extends to at least a portion of a trailing edge of the support member.

17. The drill bit arm of claim 11, wherein the pocket has curved edges having a predetermined minimum radius of curvature.

18. The drill bit arm of claim 11, wherein the pocket houses an instrumentation element during operation of the drill bit.

19. The drill bit arm of claim 18, wherein the instrumentation element includes a communication element.

20. The drill bit arm of claim 11, wherein the pocket reduces a surface area of the outer surface.

* * * * *